United States Patent [19]

Ingalls

[11] 4,445,831

[45] May 1, 1984

[54] SCREW ROTOR MACHINE ROTORS AND METHOD OF MAKING

[75] Inventor: Robert A. Ingalls, Springfield, Vt.

[73] Assignee: Joy Manufacturing Company, Pittsburgh, Pa.

[21] Appl. No.: 451,568

[22] Filed: Dec. 15, 1982

[51] Int. Cl.[3] ..... F01C 1/16; F01C 1/24

[52] U.S. Cl. ..... 418/201

[58] Field of Search ..... 418/150, 201

[56] References Cited

U.S. PATENT DOCUMENTS

| | | | |
|---|---|---|---|
| 2,462,924 | 3/1949 | Ungar | 418/201 |
| 3,164,099 | 1/1965 | Iyoi | 418/201 |
| 4,028,026 | 6/1977 | Menssen | 418/201 |
| 4,053,263 | 10/1977 | Ingalls | 418/201 |
| 4,210,410 | 7/1980 | Ohtani | 418/201 |

*Primary Examiner*—Leonard E. Smith

*Assistant Examiner*—Jane E. Obee

*Attorney, Agent, or Firm*—Raymond W. Augustin

[57] ABSTRACT

An improved screw compressor for the compression and axial displacement of a gas is set forth. The compressor is of the type having a housing formed with an axially extending passage. The axially extending passage has at one axial end thereof a gas inlet and at the other axial end thereof a gas outlet. A one piece male rotor is positioned in the passage and extends axially therein. The male rotor is formed with a plurality of helical ribs having generally convex flanks and root regions which are at least partially formed as involutes in cross section. Each rib of the male rotor has a profile consisting of a leading flank formed at least partially as an involute generated from a first base circle and a trailing flank at least partially formed as an involute generated from a second base circle. The second base circle has a diameter greater than the first base circle.

9 Claims, 8 Drawing Figures

SCREW ROTOR MACHINE ROTORS AND METHOD OF MAKING

The present invention relates to pairs of rotors for a screw rotor machine for compression or expansion of an elastic working fluid, such as those described and shown in the following U.S. Pat. Nos. assigned to Svenska Rotor Maskiner:

3,073,513; 3,073,514; 3,074,624; 3,084,851; 3,088,656; 3,088,659; 3,102,681; 3,129,877; 3,245,612; 3,423,017, under which the assignee of this invention is licensed to build such machines.

A screw rotor machine comprises generally a casing provided with a working space having high pressure and low pressure ports and including at least two intersecting bores of parallel axes, and cooperating rotors of male and female type provided with helical lands and intervening grooves with a wrap angle of less than 360°. A male rotor is a rotor in which each land and groove has at least its major portion located outside the pitch circle or the rotor and has two generally convex flanks located outside the pitch circle, while the female rotor is a rotor in which each land and groove has at least its major portion located inside the pitch circle of the rotor and has two generally concave flanks located inside the pitch circle of the rotor.

In the above cited and other patents many and various screw profiles have been proposed and in the later of the listed patents many and various shortcomings of the earlier profiles have been pointed out. Certain of the proposed profiles have been used widely in the field of compression and expansion operation without however overcoming all of the objections and particularly an objection not mentioned in any of the earlier patents known to the present inventor, namely the disadvantage resident in the difficulty of producing and measuring surfaces having profiles of generated curves as required by the latest and best screw profiles to be found in the above mentioned patents.

The present invention is directed to an improved profile partially based on involute curves producible on standard gear cutting machinery and partially of generated curves. U.S. Pat. Nos. 4,053,263 and 4,028,026 also disclose screw rotor profiles having involute curves incorporated therein.

U.S. Pat. Nos. 4,028,026 and 4,053,263 disclose profiles which consist of circular arcs and involutes. U.S. Pat. No. 4,028,026 teaches that both flanks of the male rotor should have involute sections with a front flank of each rib having a different pressure angle than the back flank. The U.S. Pat. No. 4,053,263 indicates that the front and back flanks of the male rotor have involute sections generated from the same base circle. In the present invention the male rotor has on its trailing side two different involutes generated from two different base circles. This combination curve of two involutes more closely approximates the ideal epicycloid. The two involute sections of course can be measured easily whereas an epicycloid is difficult to form and to measure. In addition, the female rotor instead of having circular sections has generated sections. These sections are generated from portions of the male rotor. The male leading flank in the design of the present invention is similar to the Linde patent in that there is an involute curve followed by a circular arc having only one radii.

Other recent patents which disclose noninvolute rotary profiles are U.S. Pat. No. 4,140,455 assigned to SRM and U.S. Pat. No. 4,088,427 assigned to Atlas Copco. Neither of these two patents deal with involute screw rotor profiles.

It is therefore an object of this invention to provide a new and improved screw rotor machine.

It is a further object of this invention to provide a new and improved screw rotor machine having rotor profiles with involute surfaces more closely approaching the ideal eipcycloidal curve.

These and other objects and advantages of this invention will become more readily apparent upon consideration of the following description and drawings in which.

Figure 1:
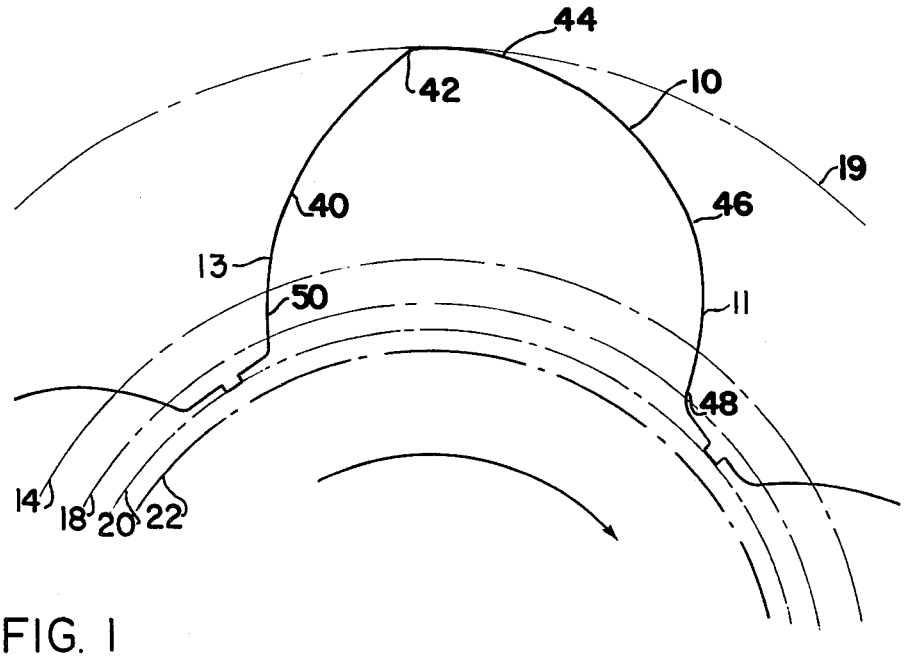
FIG. 1 is a fragmentary cross sectional view taken on the plane of rotation of a male rotor constructed according to the principles of this invention.

In FIGS. 1, 2, 4 and 5 there are shown profiles of rotor lobes generally indicated at 10 and 12 respectively and comprising respective cross sectional outlines of a male and female rotor taken on the plane of rotation. The only difference in the rotors profiles shown in FIGS. 1, 2, 4 and 5 is in the method of forming the sealing strip on the tip of the female rotor lobes. The profiles according to the principles of this invention are best described by outlining the method by which such profiles may be developed. The main parameters of the compressor are decided upon, as for instance the outside diameter of the rotors and the center distance therebetween. The pitch diameters of male and female rotors are calculated and the related root diameters are derived from the relationship to the outside diameters of the mating rotors after which the principles of the invention are applied.

In order to utilize the principles and techniques of involute gearing pressure angles for all of the involute curves of the profiles must be chosen. Once the pressure angles have been decided upon, the respective base circle diameters equal to the respective pitch diameters times the cosine of the pressure angle, are determined in the respective pitch and base circles drawn as indicated on the figures.

In the preferred embodiment of the present invention it has been found that the two involute curves on the trailing side 13 of the male rotor should be generated from a pressure angle of 14½° and 18½° respectively. The base circles developed from these angles are numbered 18 and 20. The relatively low trailing side pressure angles are necessary to decrease the blow hole area on the trailing side 13. As indicated above the use of two involutes more closely approximates the ideal epicycloid curve while still maintaining the ease of manufacture and checking of an involute curve.

The driving side 11 of the male rotor is generated from an involute curve having a pressure angle of 30°. The high driving side pressure angle is required to shorten the contact line on the driving side and also to increase cutting clearances when using hobs to generate the rotor. It should be noted that the reduction of blow hole area on the trailing side results in improved volumetric efficiency. Blow holes are the gaps which occur between trailing flanks 13, 15 of male and female rotors as meching takes place near the intersection of the stator bores. These permit communication between the Chevron shaped chambers allowing gas under pressure to leak from one chamber to another chamber having lower pressure.

The numerals 14 and 16 indicate the pitch circle diameters of the male and female rotor respectively.

The base circles of the male rotor are based upon the 14½, 18½ and 30 degree pressure angles are denoted as 18, 20, 22 respectively.

The female rotor profile also utilizes two involutes as well as a series of curves generated from the male rotor. The trailing side female involute is generated from a base circle based upon a pressure angle of 14½. This base circle is denoted as 24. The driven side 17 of the female rotor has an involute curve based upon a 30° pressure angle. This base circle is denoted as 26.

The thickness of the female rotor lobe an the pitch circle is determined to provide adequate thermal conductivity and mechanical strength to avoid deformation by the forces of compression. In the preferred embodiment there are six female lobes and four male lobes in the desired configuration. All of the female lobes and all of the male lobes are identical to one another.

Since it has been decided that there will be four male lobes in the rotor 10 and since the lobe thickness at the pitch line is known (once the thickness of the female lobe at the pitch line is determined) it is now possible to develop the trailing side 13 and in view of the known height of the male lobes base portion of the leading edge of all four lobes of the male rotor 10.

As stated above the trailing side 13 of the male rotor is formed by two involute curves having base circles 18 and 20. The curve developed from the base circle 18 meets the curve developed from the base circle 20 at point 40. The involute curve developed from base circle 20 continues until point 42. The combination of two separate involute curves simulates the epitrochoidal path of point 58 on the female rotor as the male and female rotors rotate together on their respective centers.

Figure 8:
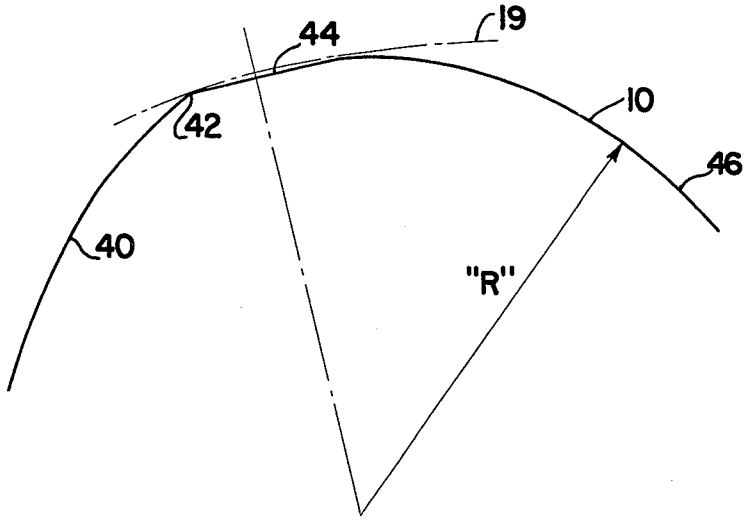
FIG. 8 is an enlarged view of the rotor tip shown in FIG. 4.

In the embodiment shown in FIG. 8, a male tip radius "R" extends from point 42 to 46. For a rotor having a nominal outer diameter Z of 6.425 inches this dimension is 1.407". The center of this radius is below the meshing or pitch circle and does not therefore coincide with the pitch circle. This radius will differ for larger or smaller rotor sizes. The 1.407" radius provides about seven thousandths of an inch difference between the outer diameter 19 and point 42 and the outer diameter 19 at point 44.

The remainder of the driving side of the male rotor is composed of an involute curved section extending from point 48 to point 46 which is generated from the base circle 22. The circular arc has its center on the male rotor lobe center line.

The female rotor has a first involute curve from point 64 to point 62. This curve is generated from base circle 26. The portion of the female rotor from point 62 to point 60 is generated by the male tip radius portion from point 46 to point 42. The portion of the female rotor from point 60 to point 58 is generated by point 42 of the male rotor. The portion of the female rotor from point 58 to point 52 is an involute generated from base circle 24.

Figure 2:
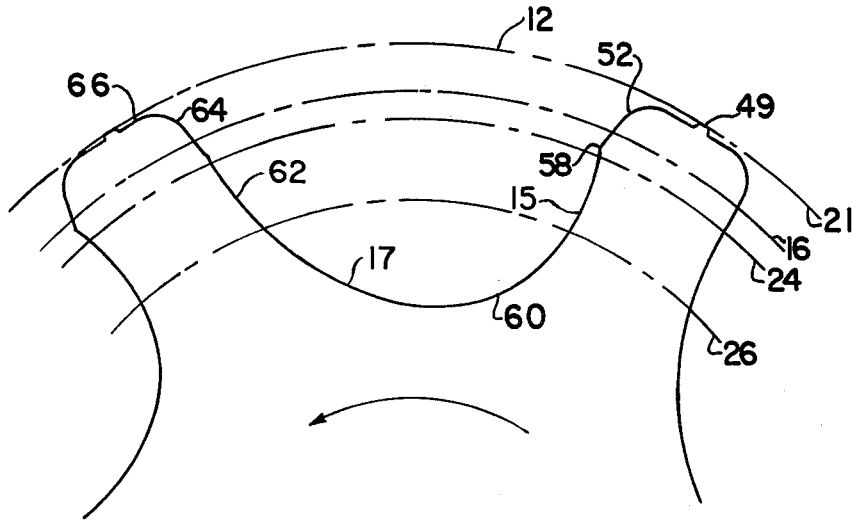
FIG. 2 is a fragmentary cross sectional view taken on the plane of rotation of a female rotor constructed according to the principles of this invention.
Figure 3:
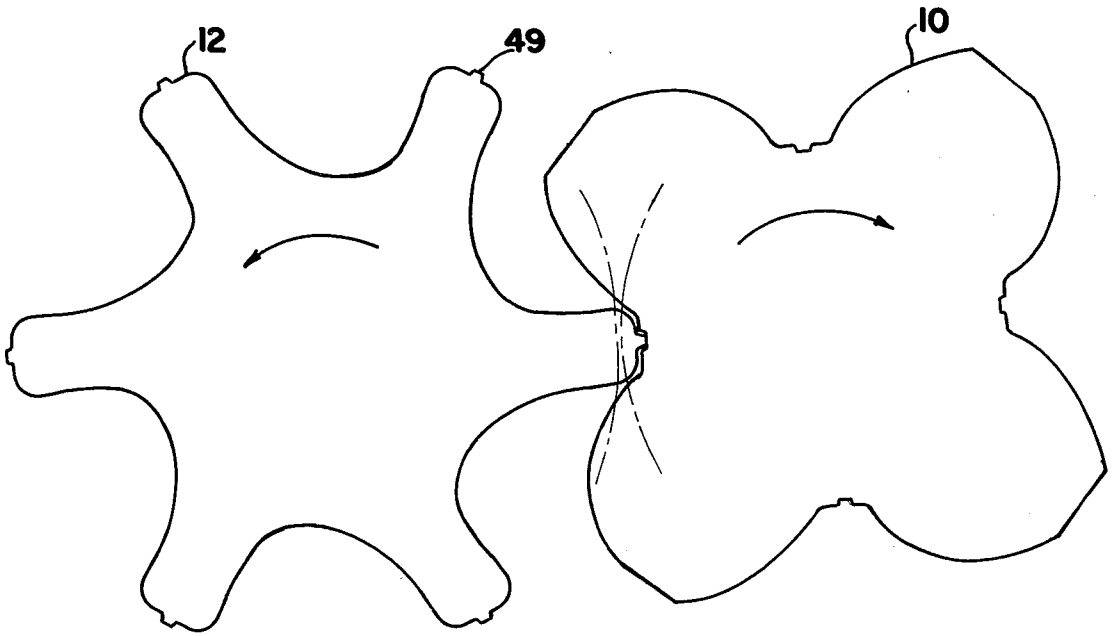
FIG. 3 is a cross section taken on the plane of rotation of a pair of rotors constructed according to the principles of this invention.
Figure 4:
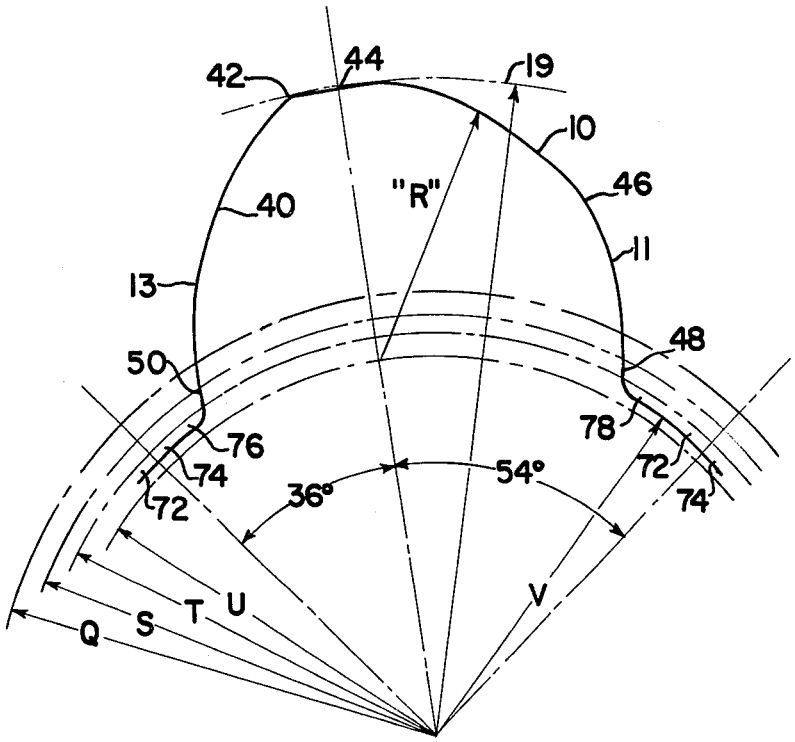
FIG. 4 is a fragmentary cross sectional view taken on the plane of rotation of a male rotor constructed according to the principles of this invention.
Figure 5:
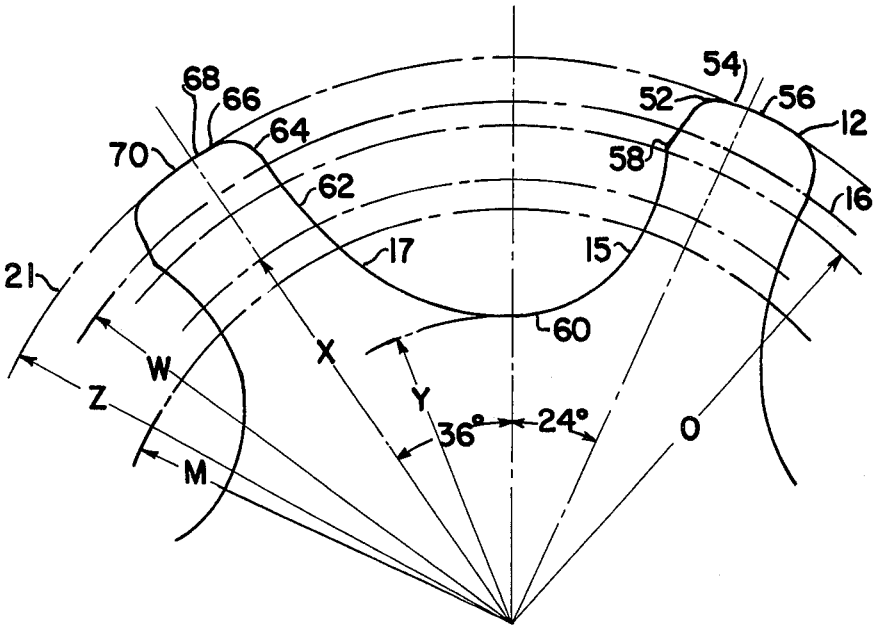
FIG. 5 is a fragmentary cross sectional view taken on the plane of rotation of a female rotor constructed according to the principles of this invention.
Figure 6:
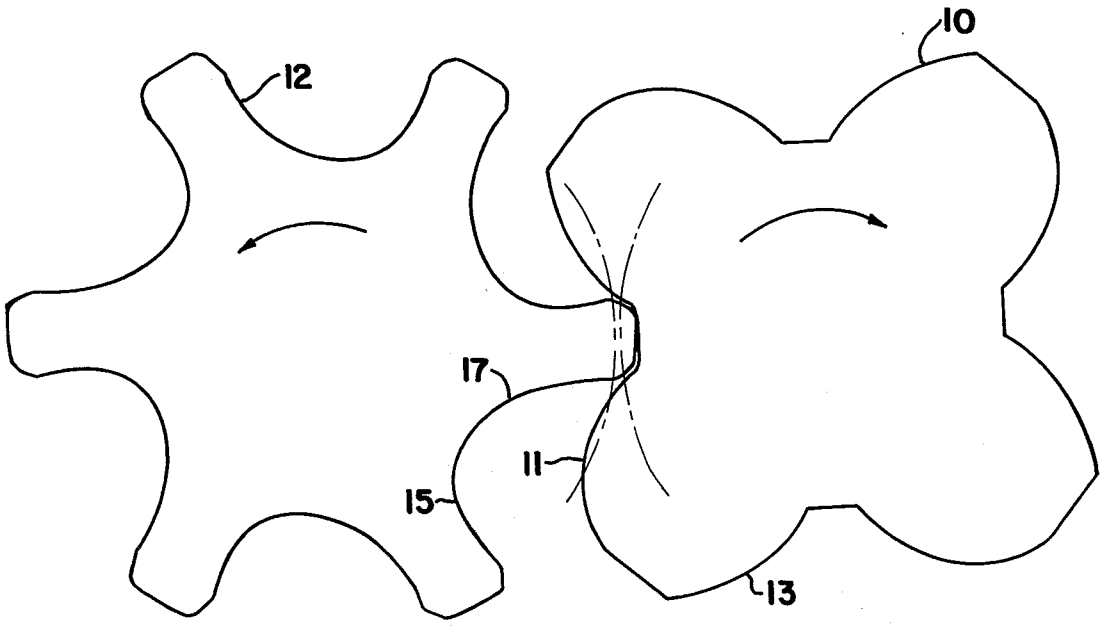
FIG. 6 is a cross section taken on the plane of rotation of a pair of rotors constructed according to the principles of this invention.

The sealing strip area between point 68 and 70 on the female lobe is a concentric sealing strip portion which is connected to point 66 by a straight line or ramp. The difference between the outer diameter 21 and the profile at point 66 is approximately five thousandths of an inch. It has been found that reductions in the size of the tip radius and the height of a sealing strip 49 of the type shown in FIGS. 1, 2 and 3 and disclosed in U.S. Pat. No. 4,053,263, the teaching of which is incorporated herein by reference, reduces the area of the leakage path or blow hole connecting the cheveron shaped compression chambers for increased volumetric efficiency. However, the embodiment disclosed in FIGS. 1 through 3 is sufficiently efficient for use.

Figure 7:
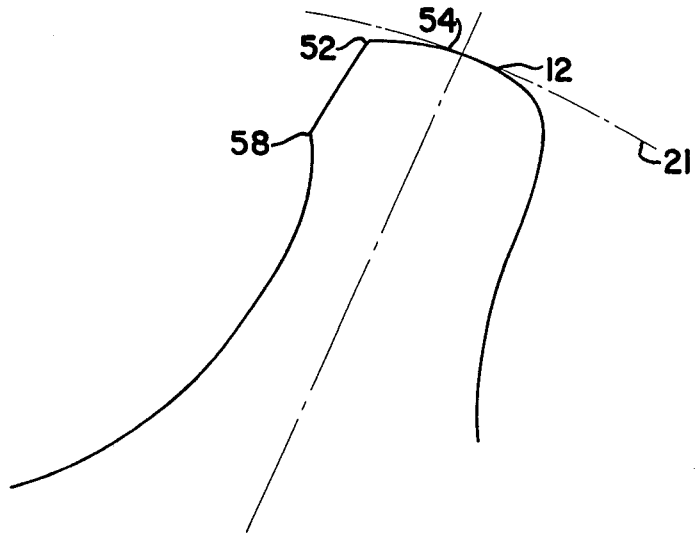
FIG. 7 is an enlarged view of the rotor tip shown in FIG. 5.

As can be seen in FIG. 7 the trailing side 15 of the female rotor lobe tin includes a sealing strip portion which is connected by a ramp to a radius portion at 52. The ramp runs from point 54 to 52. As shown, point 52 represents a 0.000 tip radius (a corner) which combined with the ramp and sealing strip will result in a minimum blow hole area. The difference between outer diameter 21 of the female rotor lobe and point 52 is about seven thousandths of an inch. The male rotor root portion 72 to 74 is generated by the portion 52 to 54 on the female rotor. The trochoidal portion 76 to 50 on the male rotor is generated by point 52 on the female rotor. Portion 72 to 78 on the male rotor is generated by ramp 68 to 66 on the female rotor. Portion 48 to 78 on the male rotor is generated by the tip radius portion 64 to 66 on the female rotor. The tip radius in the regions 64–66 on the drive side of the 6.425 inch diameter female rotor is 0.170.

It should be noted that while in preferred embodiment the radius of curvature at point 52 is 0.000 that this may vary all the way up to a curve having its center at the pitch circle thereby giving a relatively large radius on the female rotor end.

In the preferred embodiment the male and female rotor have a nominal outer diameter, Z, of 6.425 inches. The following are approximate nominal dimension for various other critical diameters for that size rotor.

| Diameters | |
|---|---|
| M 5.2371 inch | U 3.4914 inches |
| O 5.8546 inch | V 3.648 inches |
| Q 4.031496 inch | W 6.0472 inches |
| S 3.9031 inches | X 5.3967 inches |
| T 3.8232 inches | Y 3.648 inches |

These dimensions of course will vary for other size rotors.

It is to be further appreciated that although the profiles shown and described above are only generally described yet every point on those profiles is reproducible according to the method outlined regardless of the particular size of rotors desired. It is of course possible to use the same method and principles to develop rotors of more or less than the stated number of lobes as well as using other pressure angles pitch diameters and center distances as may be desired.

A preferred embodiment of the principles of this invention having hereinabove been described and shown in the figures other applications and variations on the particular design are contemplated and expected and a broad interpretation of the principles of this invention limited only by the claims herein attached is requested.

I claim:

1. An improved screw compressor for the compression and axial displacement of gas, said compressor of the type having a housing formed with an axially extending passage having at one axial end a gas inlet and at the other axial end a gas outlet, a one piece male rotor extending axially in said passage and formed with a plurality of helical ribs having generally convex flanks and root regions formed at least partially as involutes in cross section, wherein said improvement comprises:

each rib of said male rotor having a profile consisting of a leading flank formed at least partially as an involute generated from a first base circle and a trailing flank at least partially formed as an involute generated from a second base circle said second base circle having a diameter greater than said first base circle.

2. An improved screw compressor as set forth in claim 1 wherein said trailing flank of said male rotor is composed of two distinct involute curves the first of which is generated from said second base circle and the second of which generated from a third base circle, said third base circle having a diameter intermediate said first and second base circles.

3. An improved screw compressor as set forth in claim 1 wherein said first base circle is based upon a pressure angle having a range from 27.5° to 32.5° and said second base circle is based upon a pressure angle having a range from 13° to 16°.

4. An improved screw compressor as set forth in claim 2 wherein said third base circle is based upon a pressure angle having a range from 15.5° to 20.5°.

5. An improved screw compressor for the compression and axial displacement of a gas, said compressor of the type having a housing formed with an axially extending passage having at one axial end a gas inlet at the other axial end of the gas outlet, a one piece female rotor extending axially in said passage and formed with a plurality of helical ribs having generally concave flanks formed at least partially as involutes in cross section, said improvement comprising:

the leading flank of each rib of said female rotor being formed at least partially as a convex involute generated from a first base circle, the trailing flank of each flank of each flank of each rib of said female rotor being formed at least partially as a convex involute generated from a second base circle said second base circle having a diameter greater than said first base circle, said first base circle based upon a pressure angle in the range of 27.5° to 32.5° and said second base circle based upon a pressure angle in the range of 13° to 16°.

6. An improved screw compressor for the compression and axial displacement of a gas, said compressor having a housing formed with an axially extending passage having at one axial end a gas inlet and at the other axial a gas outlet, a one piece male rotor extending axially in said passage and forms a plurality of helical ribs having generally convex flanks formed at least partially as involutes in cross section, a one piece female rotor extending axially in said passage and formed with a respective plurality of helical ribs meshing with said ribs of said male rotor and having generally concave flanks formed at least partially as involutes in cross section, wherein the improvement comprises:

each rib of said male rotor having a profile consisting of a leading flank foremd at least partially of an involute generated from a first base circle and a trailing flank formed at least partially of an involute generated from a second base circle wherein said second base circle is of a diameter greater than said first base circle;

each rib of said female rotor having a leading flank formed at least partially from an involute generated from a third base circle thereon and a trailing flank being formed at least partially from an involute generated from a fourth base circle thereon wherein said fourth base circle is of a diameter greater than said third base circle; and said first and third base circles based upon a pressure angle of between 27.5 and 32.5 degrees and said second and fourth base circles based upon a pressure angle between 13 and 16 degrees.

7. An improved compressor as set forth in claim 6 wherein said leading flank of said female rotor has at least a portion congugate to a portion on the leading flank of said male rotor and at least part of said trailing portion of said female rotor being generated from a point on said trailing flank of said male rotor.

8. An improved screw compressor as set forth in claim 6 wherein said female rotor tip including a ramp from the center portion thereon and sloping radially inwardly to the intersection with said involute formed from said fourth base circle.

9. An improved screw compressor as set forth in claim 8 wherein said ramp extends radially inwardly less than 0.010" from the outer diameter of said central portion of said point of intersection of said involute formed from said fourth base circle.

* * * * *